US005361465A

United States Patent [19]

O'Donnell

[11] Patent Number: 5,361,465

[45] Date of Patent: Nov. 8, 1994

[54] FLUID RETAINING CONTAINER

[76] Inventor: James H. O'Donnell, 50734 Meadow Green Ct., Granger, Ind. 46530

[21] Appl. No.: 14,850

[22] Filed: Feb. 8, 1993

[51] Int. Cl.[5] ..... E02D 19/00

[52] U.S. Cl. ..... 27/29; 206/204

[58] Field of Search ..... 27/28, 29; 206/204; 260/33.2

[56] References Cited

U.S. PATENT DOCUMENTS

| | | | |
|---|---|---|---|
| 4,119,604 | 10/1978 | Wysong | 260/33.2 |
| 4,790,051 | 12/1988 | Knight | 27/28 |
| 4,927,010 | 5/1990 | Kannankeril | 206/204 |
| 5,030,404 | 7/1991 | Bonnebat et al. | 264/185 |
| 5,061,235 | 10/1991 | Hogan | 27/28 |
| 5,073,202 | 12/1991 | Wallach | 134/6 |
| 5,116,139 | 5/1992 | Young et al. | 383/49 |

*Primary Examiner*—Lanna Mai
*Assistant Examiner*—Kien Nguyen
*Attorney, Agent, or Firm*—Leo H. McCormick, Jr.

[57] ABSTRACT

A container has a fill material which consists of a mixture of super absorbent material, a biocide or neutralizing agent, and a fragrance. The container also includes a top member having a membrane member which allows fluids to be communicated with the fill material and air can be escape from the container to indicate that a reaction has occurred between the fluids and the fill material.

8 Claims, 2 Drawing Sheets

FLUID RETAINING CONTAINER

BACKGROUND OF THE INVENTION

The present invention is directed to a multi-use container having a pad to be used whenever it is desirable for retaining fluids and neutralizing any microorganisms present therein.

With the discovery of the HIV virus, it has become increasingly important for health care workers to protect themselves from contact with blood products or other likely virulent body fluids from potentially infected persons, or persons whose HIV status is unknown. These health care workers may include emergency service teams, hospital staff and mortuary personnel.

In order to solve the problem of potential cornmingling of body fluids, I have devised a container wherein fluids will be absorbed and any microorganisms therein are neutralized. The container is comprised of a top member attached to a watertight base member. The top member selectively allows fluids to flow into a mixture of super-absorbent material, fragrance, and a biocide or other selected neutralizing agent.

The present invention relates to the process of manufacture and composition of a container to be used to trap, and render substantially sterile, fluids leaking from injured or deceased bodies while in some cases emitting an odor-masking fragrance.

The present invention describes a process of manufacture and composition of a container to be used to trap and render substantially impotent, fluids, released due to unexpected leaks, while emitting a distinctive odor which identifies the leaking fluid and its location.

It is an object of this invention to retain fluids and neutralize any microorganisms residing therein.

A further object of this invention is to release an odor during reaction of a fluid with a fill material.

Another object of this invention is to provide protection for humans from contact with body fluids which may contain harmful microorganisms.

A still further object of this invention is to neutralize chemicals which have passed through a top member of a container.

These objects and others should be readily apparent from reading the following specification while viewing the drawings wherein.

Figure 1:
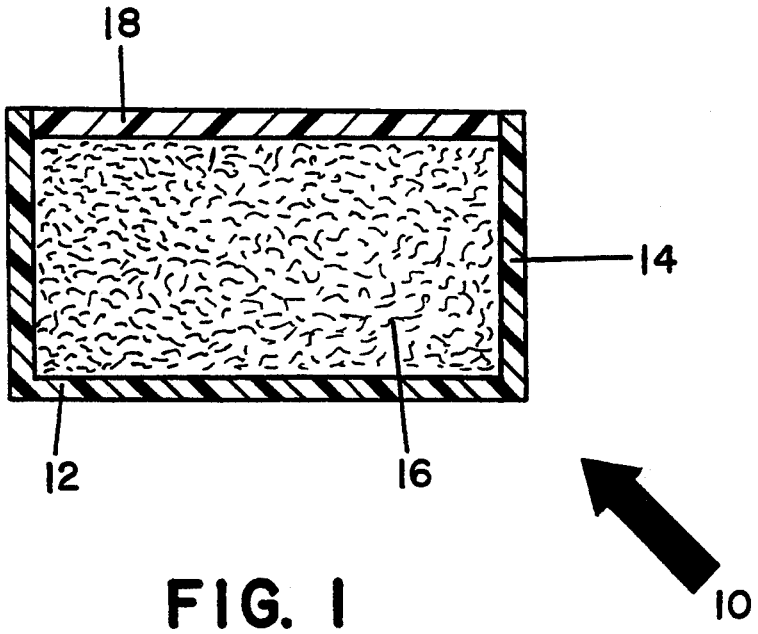
FIG. 1 is a sectional view of a container made in accordance with the principles of this invention.
Figure 2:
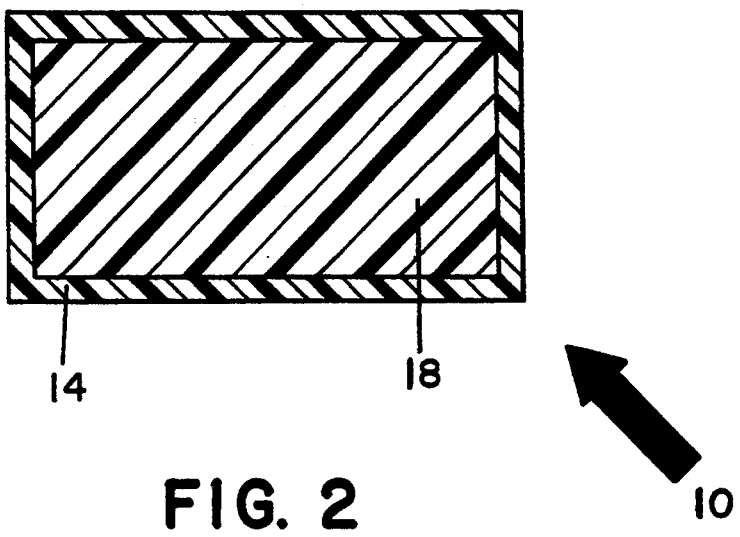
FIG. 2 is a top view of the container shown in FIG. 1.

The container 10, as shown in FIGS. 1 and 2, has a housing having a base 12, with integral sides 14 extending therefrom. The housing is made from a flexible, watertight material such as a polymer. A fill material 16, containing a mixture including a super-absorbent material, a biocide or a neutralizing agent and a fragrance, is located within the housing and covered by a top member 18 attached to the sides 14.

The super-absorbent in the fill material 16 can be selected from a class of materials including polyacrylate particles or a combination of a branched-chain polyanionic carbohydrate, a cross linking agent and a hydrophobic carboxylic acid as described in U.S. Pat. No. 5,073,202;

The biocide in the fill material 16 can be selected from a class of materials including protein denaturants such as urea or sodium dodecyl sulfate; poisons such as phenol; or agents designed to raise or lower Ph.

The odor masking fragrance in the fill material 16 can be selected from a class of materials including esters or aromatic aldehydes such as cinnaminaldehyde which have been microencapsulated or emulsified in starch and spray dried into a dry powder.

The top member 18 is made from a class of materials including polyvinyl alcohol film which reacts with fluids having specific temperature ranges allowing those fluids to advance into the fill material 16; or a membrane having a pore size which limits the transfer of fluids as a function of the pore size such that only sweat, oils, acids, spit, saliva, blood, urine, water and air pass through and come in contact with the fill material 16. Once the fluids come into contact with the fill material a reaction occurs and they are neutralized while at the same time the reaction with the fragrance produces a distinctive odor to indicate that a leak has occurred. The top member may be skid resistant.

Figure 3:
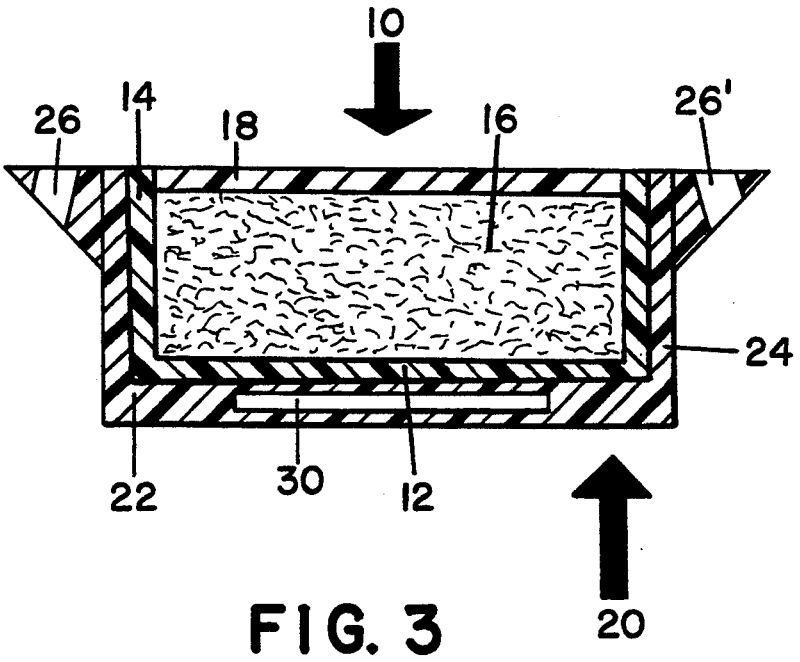
FIG. 3 is a sectional view of the container shown in FIG. 1 partially enclosed in a housing.

As shown in FIG. 3, a container 20, having a base member 22 and sides 24, encases the container 10. The base member 22 includes a horizontal opening 30 into which a reinforcing member may be inserted to provide strength and stability during transportation of container 20.

Figure 4:
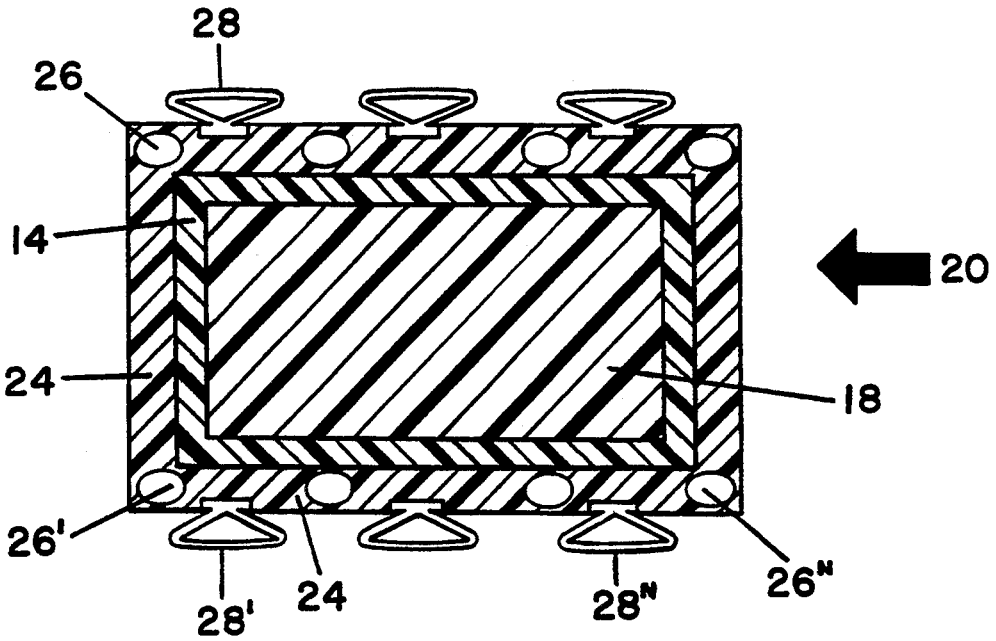
FIG. 4 is a top view of the embodiment shown in FIG. 3 having openings in and handles thereon to facilitate transportation of the container.

The container 20 may include a plurality of openings 26, 26' . . . 26$^n$, in the sides 24, through which retaining straps may be passed, and a plurality of handles 28, 28' . . . 28$^n$, which are attached to the sides 24, for ease of transport as best shown in FIG. 4.

Where a body is placed upon on container 10, any leaking body fluids permeate the top member 18 and are trapped by the fill material 16 which retains the fluid and terminates substantially all microbial populations in the fluid, and a fragrance is released to mask the odor indigenous to the fluid or that odor caused by the reaction of the microbial populations and the biocide. A select top member 18 may keep saturated fill material 16 from escaping and contacting whatever is placed thereon.

When used by emergency service teams, a reinforcing member may be inserted into slot 30 of container 20 before use and removed thereafter. The container 20 has several openings 26,26' . . . 26$^n$ along the sides 24 through which straps may be passed to restrain a body resting thereon.

The container 10, may also be attached to line the insides of airtight bags used in the transportation of dead bodies, or parts of bodies, thereby substantially reducing worker exposure to fluids when the contents of the bags are removed.

When the top member 18 of container 10, is comprised of polyvinyl alcohol film, the container 10 may be used to line the back of clothing worn by cadavers during their display prior to burial. The fill material 16 absorbs fluids which might leak from the cadaver, and terminates microbial activity in the trapped fluids while emitting a fragrance, thereby avoiding embarrassment to the family of the deceased and the funeral director.

What is claimed is:

1. A container and fill material for neutralizing any microorganisms in fluids that may be harmful to the health of a person, said container having a base member with four sides extending thereon and a top member for retaining said fill material, said base and four sides being made of a non-water soluble polymer, said fill material consisting of a mixture of super-absorbent material, a biocide, and a fragrance, said top member consisting of a membrane which allows said fluids to be communicated to said fill material, said super absorbent material consisting of a class of materials including polyacralate particles or a combination of a branched chain polyionic carbohydrate, a cross linking agent and a hydrophobic carboxylic acid, said fragrance consisting of particles selected from a class of materials including esters or cinnaminaldehyde which have been microencapsulated or emulsified in a starch and spray dried into a dry powder, said container retaining fluids that have been communicated to said fill mixture of super-absorbent, biocide and fragrance, said biocide terminating substantially all microbial populations of said microorganisms that may be present in the fluids while said super absorbent material retains said fluids in said container and said fragrance is immediately release as a result of a reaction with said fluids to create a masking odor and indicate that a leak has occurred.

2. The container as recited in claim 1 wherein said polyvinyl alcohol film reacts with fluid having selected reactive temperature ranges between 10 degrees to 100 degrees C.

3. The container as recited in claim 1 wherein said container is used to line the inside of airtight bags.

4. The container as recited in claim 1 wherein said membrane has a pore size to limit the communication of fluids into said fill materials.

5. The container as recited in claim 1 wherein said membrane is made from a soluble polyvinyl alcohol film which dissolves on contact with said fluids to allow immediate reaction with said fill materials.

6. The container as recited in claim 1 further including a second container which surrounds said container to provide addition strength, said second container being made from an inelastic non-water soluble polymer.

7. The container as recited in claim 6 further including handles attached to said second container and means to provide additional support to said base.

8. A container and fill material for neutralizing any fluids that may be harmful to the health of a person, said container comprising a base member with four sides extending thereon and a top member for retaining said fill material, said base and four sides being made of a non-water soluble polymer, said fill material consisting of a mixture of super-absorbent material, a neutralizing agent, and a fragrance, said top member consisting of a membrane having a pore size which limits the communication of said fluids to said fill material, said super absorbent material consisting of a class of materials including polyacralate particles or a combination of a branched chain polyionic carbohydrate, a cross linking agent and a hydrophobic carboxylic acid, said fragrance consisting of particles selected from a class of materials including esters or cinnaminaldehyde which have been microencapsulated or emulsified in a starch and spray dried into a dry powder, said container retaining fluids that have been communicated to said fill mixture of super-absorbent, biocide and fragrance, said neutralizing agent neutralizing said fluids while said super absorbent material retains said fluids in said container and said fragrance is immediately release as a result of a reaction with said fluids to create a masking odor and indicate that a leak has occurred.

* * * * *